US006285129B1

(12) United States Patent
Park et al.

(10) Patent No.: US 6,285,129 B1
(45) Date of Patent: Sep. 4, 2001

(54) HELIUM PLASMA DISPLAY DEVICE

(75) Inventors: Deuk-il Park; Joong-woo Nam, both of Suwon (KR)

(73) Assignee: Samsung Display Devices Co., Ltd., Kyungki-Do (KR)

( * ) Notice: Subject to any disclaimer, the term of this patent is extended or adjusted under 35 U.S.C. 154(b) by 0 days.

(21) Appl. No.: 09/179,962

(22) Filed: Oct. 28, 1998

(30) Foreign Application Priority Data

May 12, 1997 (KR) ..... 97-66334

(51) Int. Cl.[7] ..... H01J 1/62; H01J 63/04; H01J 17/49; H01J 17/20; H01J 61/12

(52) U.S. Cl. ..... 313/586; 313/485; 313/484; 313/582; 313/637; 313/643

(58) Field of Search ..... 313/493, 582, 313/583, 584, 585, 586, 587, 483–485, 486, 487, 637, 643; 315/169.1, 169.4; 445/24, 50

(56) References Cited

U.S. PATENT DOCUMENTS 3,769,543 * 10/1973 Pennebaker ..... 315/169.4
3,925,697 * 12/1975 Fein et al. ..... 313/582
4,000,436 * 12/1976 Toryu et al. ..... 313/487
4,081,712 * 3/1978 Bode et al. ..... 313/586
4,147,958 * 4/1979 Ahearn et al. ..... 315/169.4
4,419,605 * 12/1983 Branston ..... 313/485
5,789,862 * 8/1998 Makino ..... 313/585 X
5,793,158 * 8/1998 Wedding, Sr. ..... 313/493
5,914,563 * 6/1999 Lee et al. ..... 313/585
6,007,399 * 12/1999 Mehrotra et al. ..... 445/50

* cited by examiner

*Primary Examiner*—Nimeshkumar D. Patel
*Assistant Examiner*—Mack Haynes
(74) *Attorney, Agent, or Firm*—Lowe Hauptman Gilman & Berner, LLP

(57) ABSTRACT

A plasma display device including: an upper substrate provided with address electrodes; a dielectric material and a fluorescent material coated on the lower surface of the upper substrate; a lower substrate provided with scan electrodes and common electrodes; and a discharge gas of pure He or a gas mixture of more than 99.5 vol % He and the balance of at least one gas selected from the group consisting of Ne, Ar, Kr, Xe and $N_2$, and hermetically sealed between the upper and lower substrates.

4 Claims, 7 Drawing Sheets

HELIUM PLASMA DISPLAY DEVICE

BACKGROUND OF THE INVENTION

1. Field of the Invention

The present invention relates to a plasma display device, and more particularly, to a plasma display device employing a gas mixture of helium and rare gases as a discharge gas.

2. Description of the Related Art

The plasma display device, which displays images utilizing gas discharges exhibits excellent luminance and contrast, and has a wide view angle. The plasma display device forms images by applying AC or DC voltages to electrodes to discharge a gas to thereby emit ultraviolet rays, and the emitted ultraviolet rays excite fluorescent materials to emit light.

The gas typically used as a plasma discharge gas is a mixture of Ne and Xe, or a mixture of He and Xe, and in this case the content of Xe is about 1–5 vol %. When the gas mixture as above is used, the reaction of Xe prevails at the time of discharges, and vacuum ultraviolet rays of wavelengths from about 147 to 200 nm are emitted. Accordingly, the prior plasma display device is provided with fluorescent materials to be excited by the ultraviolet rays whose wavelengths are from about 147 to 200 nm.

However, when a mixture of Ne—Xe, or He—Xe is employed as a discharge gas, in addition to the ultraviolet rays, intense near infrared rays whose wavelengths are from about 800 to 1,000 nm are emitted from Xe, and such near infrared rays may abnormally operate other nearby appliances which are operated by remote control.

Therefore, the plasma display must be provided with a filter for shielding the near infrared rays. Such a filter is known to not only increase the production cost but also to decrease the luminance of an image by at least 30%. In addition, there is a problem in that when a mixture of Ne and Xe is used as a discharge gas, visible light including intense yellow or red color is emitted from Ne gas, and therefore the color purity of displayed images is deteriorated.

Further, as the pressure of the gas mixture increases, the discharge characteristics of the Ne—Xe or He—Xe mixture are very unstable.

SUMMARY OF THE INVENTION

To solve the above problems, it is an objective of the present invention to provide a plasma display device employing a gas mixture of helium and rare gases as a discharge gas, which exhibits stable discharge characteristics, emission of yellow or red light is minimized, and does not emit near infrared rays of wavelength from about 800 to 1,000 nm.

Accordingly, to achieve the above objective, there is provided a plasma display device including: an upper substrate provided with address electrodes; a dielectric material and a fluorescent material coated on the lower surface of the upper substrate; a lower substrate provided with scan electrodes and common electrodes; and a discharge gas of pure He or a gas mixture of more than 99.5 vol % He and the balance of at least one gas selected from the group consisting of Ne, Ar, Kr, Xe and $N_2$, and hermetically sealed between the upper and lower substrates.

Further, the pressure of the discharge gas is preferably 100–760 torr.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

As a discharge gas of a helium discharge display device according to the present invention, pure helium or a gas mixture of a helium base gas of 99.5 vol % and at least one of neon (Ne), argon (Ar), krypton (Kr), xenon (Xe) and nitrogen ($N_2$) is used, which exhibits excellent discharge characteristics and does not emit near infrared rays of 800–1,000 nm.

Here, the content of the rare gas and $N_2$ is limited to less than about 0.5 vol %, this is for the purpose of inducing ultraviolet radiation by the transitions in He atoms and restraining the emission of visible light and near infrared rays.

Figure 1:
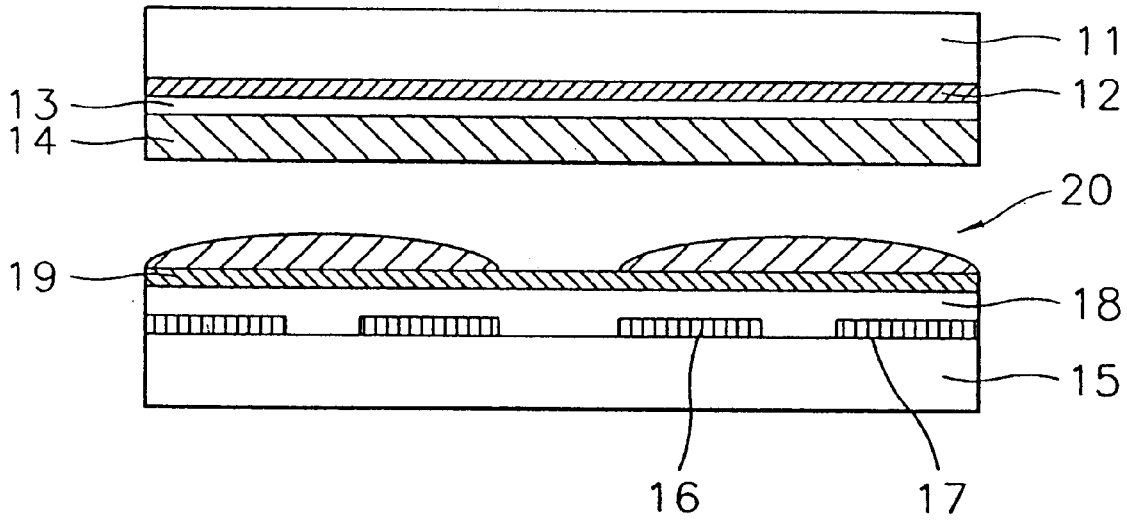
FIG. 1 is a section view illustrating a helium discharge display device according to the present invention.

A helium discharge display device according to a preferred embodiment of the present invention is shown in FIG. 1. Referring to FIG. 1, address electrodes 12 are formed on the lower surface of an upper substrate 11, and a dielectric material 13 and a fluorescent material 14 are coated in turn on the lower surface of the upper substrate 11 provided with the address electrodes 12. In addition, scan electrodes 16 and common electrodes 17 are formed on the lower substrate 15, and a dielectric material 18 and a MgO protection film 19 are coated on the electrodes 16 and 17.

The upper substrate 11 and the lower substrate 15 are attached to each other, while spaces therebetween are hermetically filled with a discharge gas. Here, the discharge gas is, as described above, pure He or a gas mixture of a helium base gas of 99.5 vol % and at least one of Ne, Ar, Kr, Xe and $N_2$. If the content of Ne, Ar, Kr, Xe and $N_2$ in the discharge gas surpasses 0.5 vol %, it is found that luminance decreases, and discharge voltage becomes undesirably high.

In addition, conventional fluorescent materials are used as the fluorescent material 14.

In the operation of a plasma display device as described above, when an AC voltage of about 180 V is applied across the scan electrodes 16 and the common electrodes 17 after a pulse voltage of about 190 V is applied to the address electrodes 12, the pure He or He base mixture gas in the discharge spaces 20 between the scan electrodes 16 and the common electrodes 17 is ionized to be in a plasma state. At this moment, since the content of Ne, Ar, Kr, Xe and $N_2$ is limited to 0.5 vol %, the discharge of He prevails, and the vacuum ultraviolet rays emitted therefrom excite the fluorescent material 14 to emit light.

On the other hand, since only a trace of near infrared rays of 800–1,000 nm are emitted from the He, a separate filter is not required to shield the infrared rays. In addition, the pressure of the discharge gas is set to be over about 100 torr, and preferably 760 torr which is the same as the atmospheric pressure. If the pressure is lower than 100 torr, the efficiency of the emission of light is lowered, and the discharge start voltage becomes higher. On the other hand, if the pressure is higher than 760 torr, the discharge panel may be deformed.

Such an effect of the present invention can be clearly understood by the following experimental example.

Experimental Example

Figure 2:
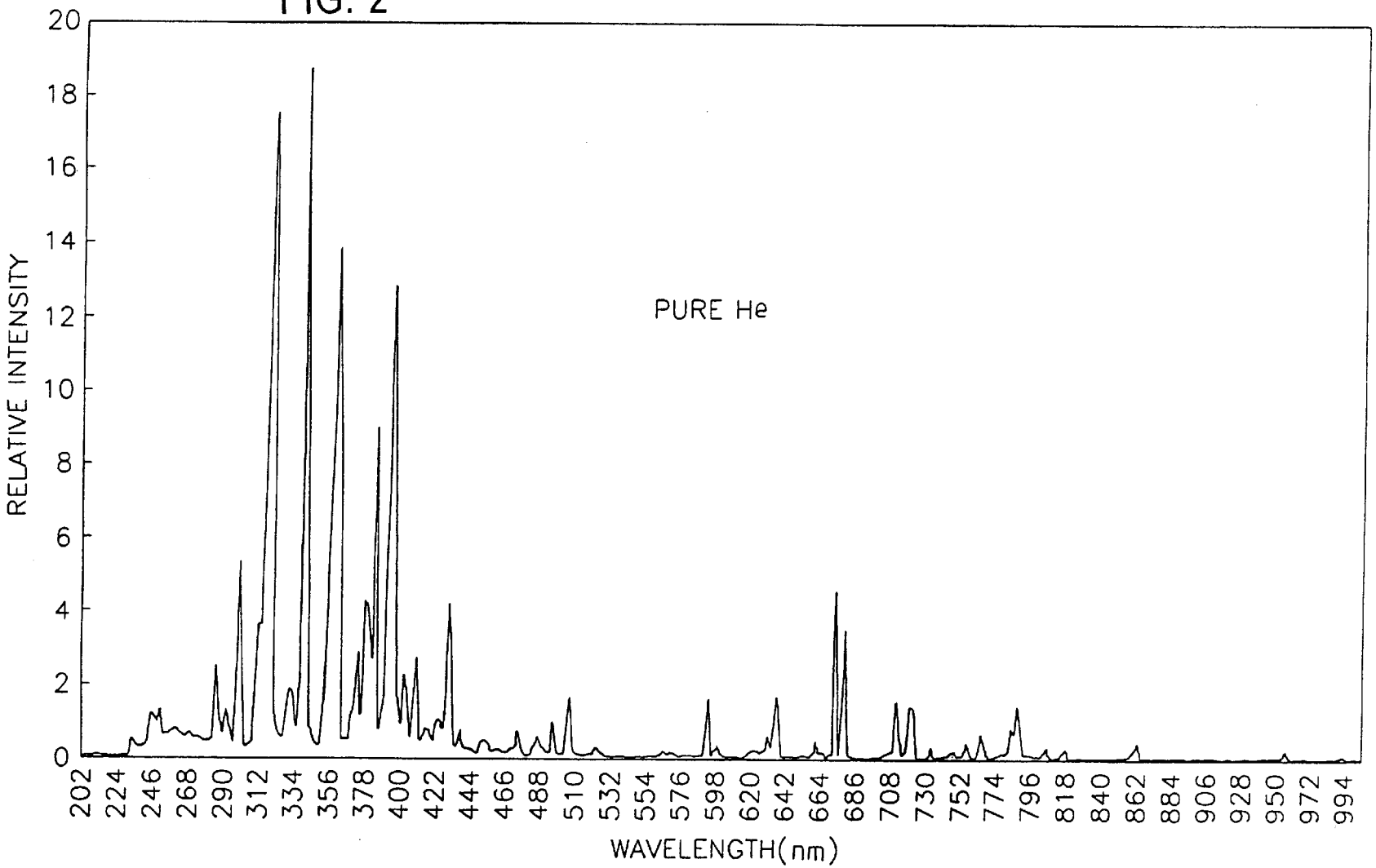
FIG. 2 is a graph illustrating the discharge spectrum of a display device employing a pure helium discharge gas according to the present invention.

The discharge gases used in this example for measuring the spectra of visible light and near infrared rays of the discharge gases were pure He, and gas mixtures of He—Ne (10 vol %), He—Ar (0.1 vol %), He—Ar (0.01 vol %), and He—Ne (30 vol %)-Xe (5 vol %). In this experiment, the panel used in spectrum measurement has a surface discharge type structure, and employs a quartz plate for a measurement surface of the test panel for precisely measuring the intensities of emitted light in the range of ultraviolet light. At this time, the pressure of the discharge gas was 350 torr, the driving voltage was 230 V, and the driving frequency was 50 kHz. FIG. 2 shows the spectrum of the pure He gas in relative intensities, FIG. 3 shows the spectrum of He—Ne (10 vol %) mixture in relative intensities, FIG. 4 shows the spectrum of He—Ar (0.1 vol %) mixture in relative intensities, and FIG. 5 shows the spectra of He—Ar (0.01 vol %) and He—Ne (30 vol %)-Xe (5 vol %) mixtures in relative intensities.

As shown in FIG. 2, the spectrum from the pure He gas discharge exhibit strong intensities in the ultraviolet range of 300–400 nm, and very weak intensities in the visible light and infrared ranges.

Figure 3:
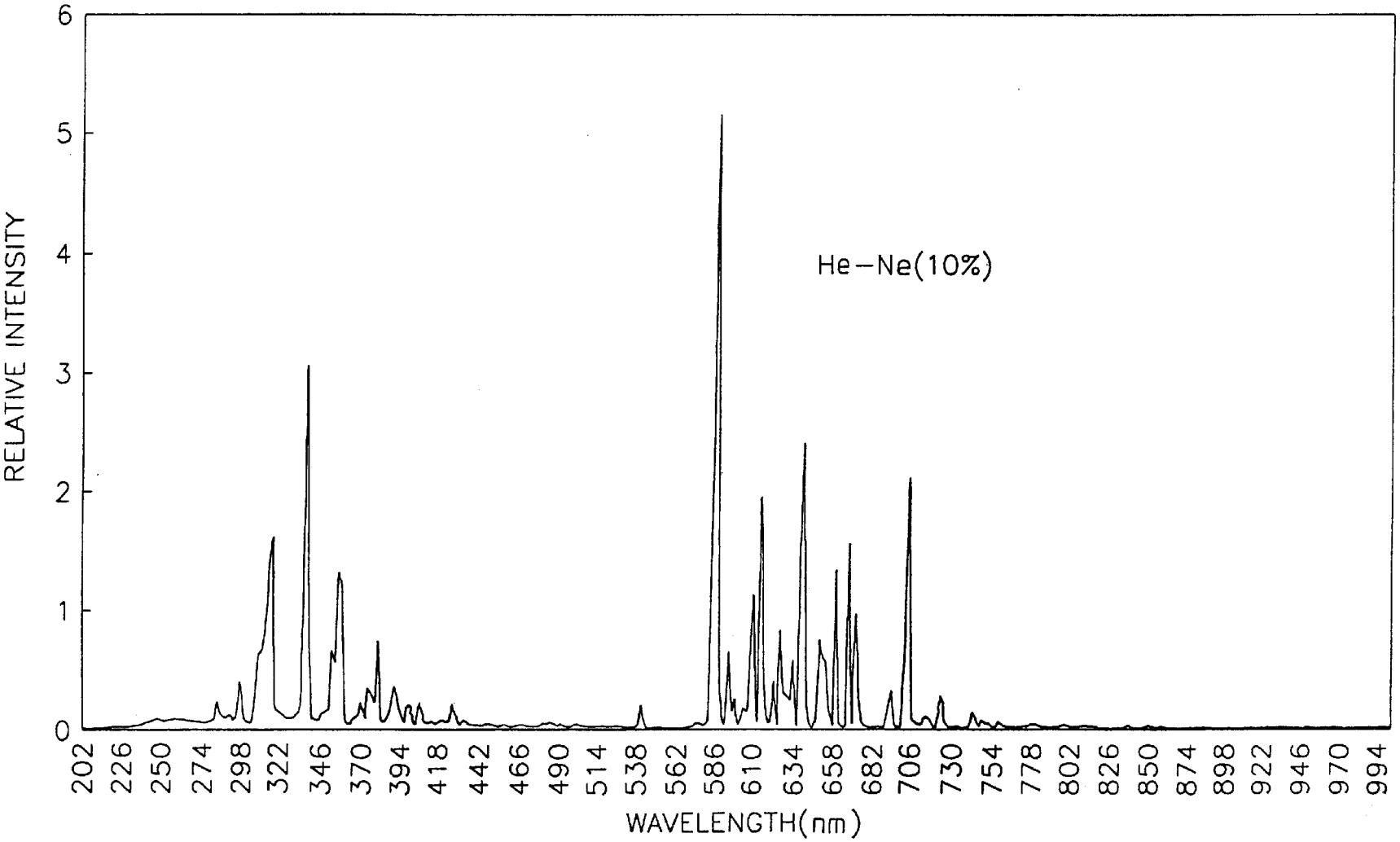
FIG. 3 is a graph illustrating the discharge spectrum of a display device employing a He—Ne (10 vol %) discharge gas according to the present invention.

In the graph of FIG. 3, it was found that the intensity of visible light, i.e., yellow light from Ne is stronger than that of ultraviolet from He. Accordingly, in the He—Ne gas mixture, since the intensity of yellow light becomes stronger when the amount of Ne reaches about 0.5 vol %, it is preferable to reduce the amount of Ne as much as possible.

Figure 4:
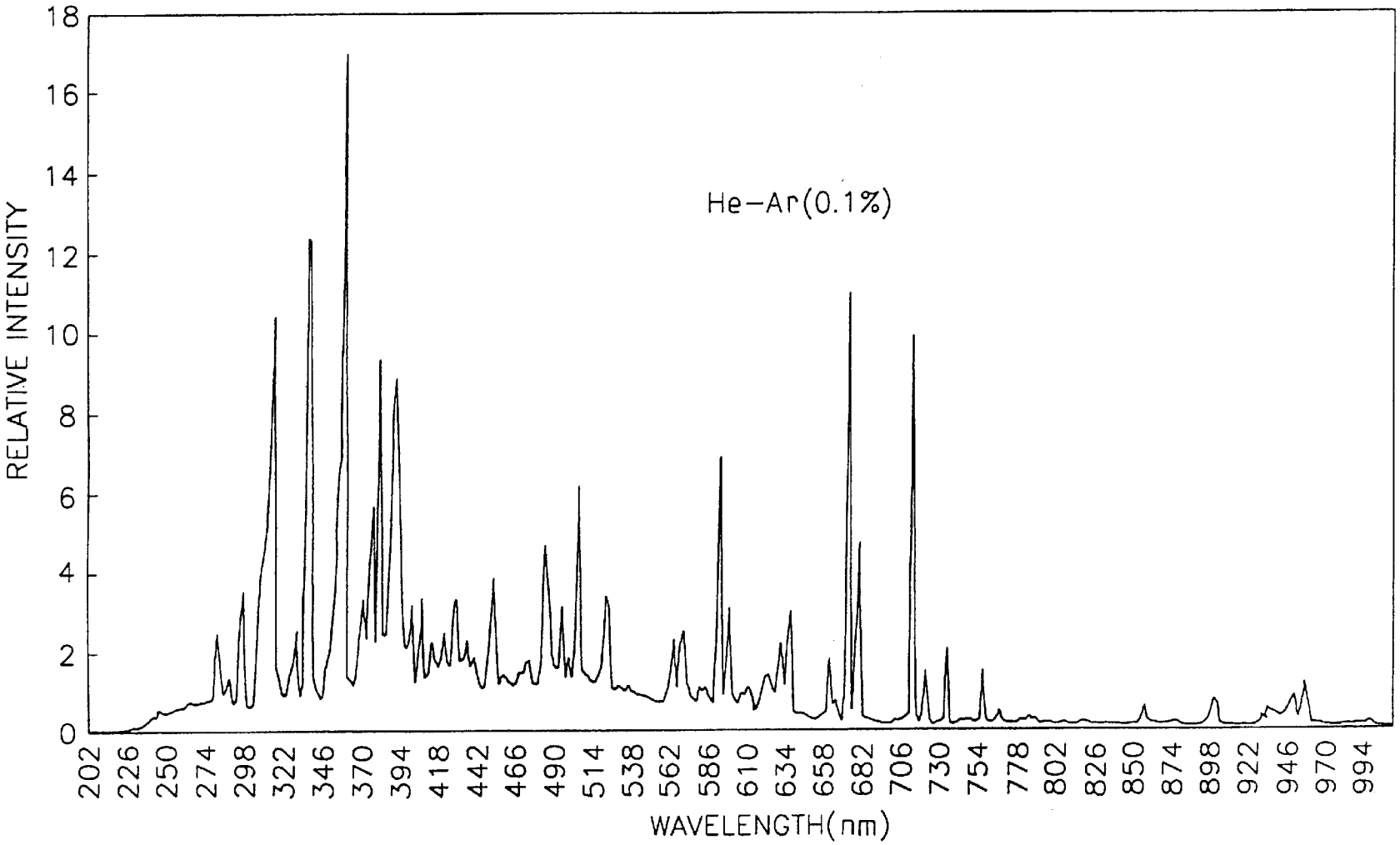
FIG. 4 is a graph illustrating the discharge spectrum of a display device employing a He—Ar (0.1 vol %) discharge gas according to the present invention.
Figure 5:
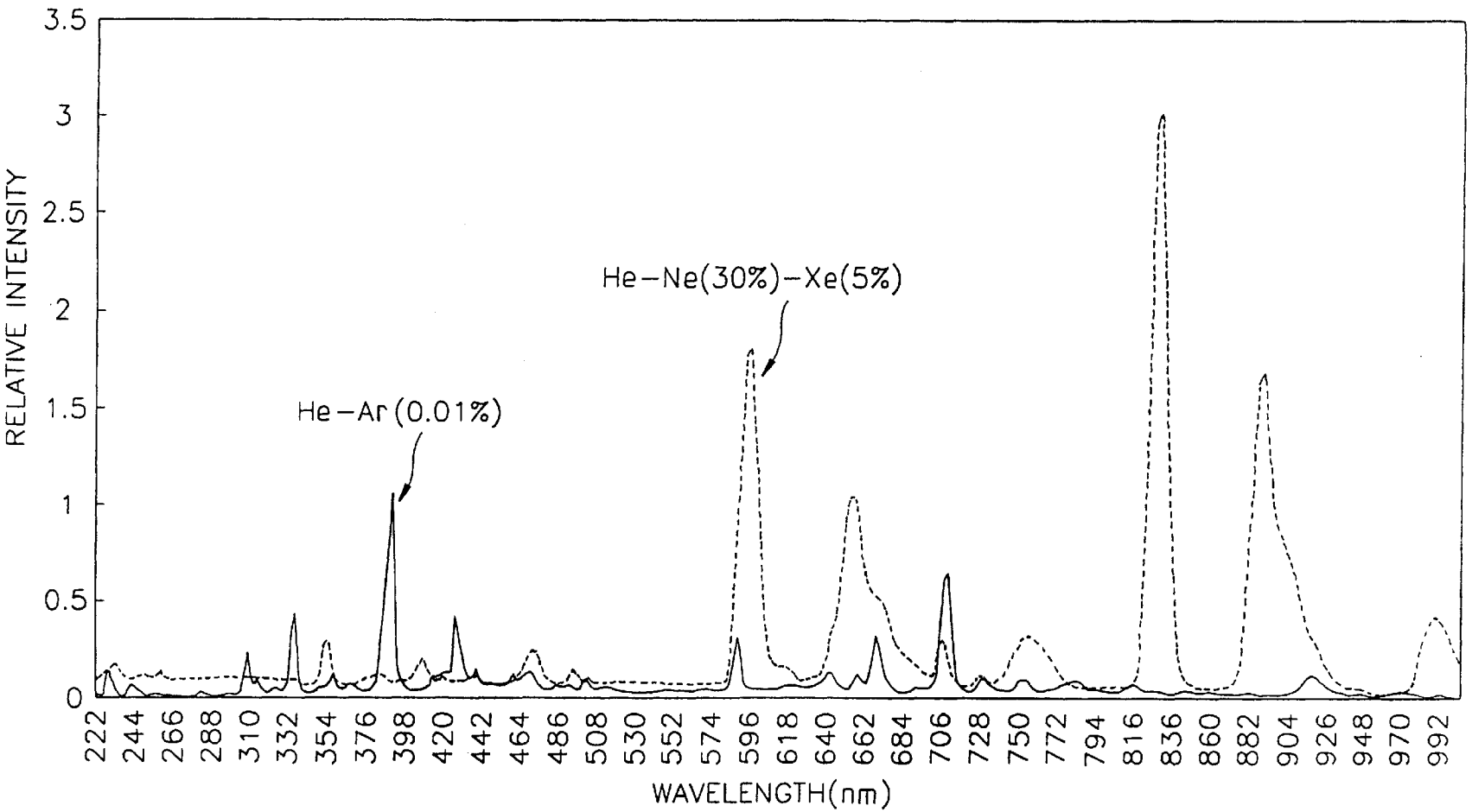
FIG. 5 is a graph illustrating the respective discharge spectra of a display device employing a He—Ar (0.01 vol %) discharge gas according to the present invention and a conventional discharge display device employing a He—Ne (30 vol %)-Xe (5 vol %) discharge gas.

FIG. 4 shows the spectrum of a He—Ar (0.1 vol %) discharge gas. Referring to FIG. 4, it was found that the characteristics of the spectrum are similar to those of the pure He gas. However, when Ar gas was added to He gas by an amount of 0.1 vol %, it was found that the intensities of ultraviolet and visible light rays were stronger.

In FIG. 5, the visible lines represent the spectrum of He—Ar (0.01 vol %), and the hidden lines represent the spectrum of He—Ne (30 vol %)-Xe (5 vol %). As shown in FIG. 5, ultraviolet light of wavelength of about 389 nm and visible light of wavelength of about 706 nm appeared intense. Such ultraviolet and visible light radiations resulted from the transitions of He atoms.

On the hand, the spectrum of the He—Ne (30 vol %)-Xe (5 vol %) discharge gas exhibited strong intensities in the wavelength ranges of visible light rays of 590 and 640 nm, and near infrared light rays of around 830 and 900 nm. The light rays of wavelengths of 590 and 640 nm were generated by the transitions of Ne atoms, and the emission of red light of 640 nm became stronger according to the increase of Ne content. Also, the near infrared light ray of around 830 and 900 nm resulted from the transitions of Xe atoms.

Consequently, it was found that the intensities of visible and near infrared light radiations of the He—Ar (0.01 vol %) discharge gas were much weaker than those of the conventional He—Ne (30 vol %)-Xe (5 vol %) discharge gas.

Figure 6:
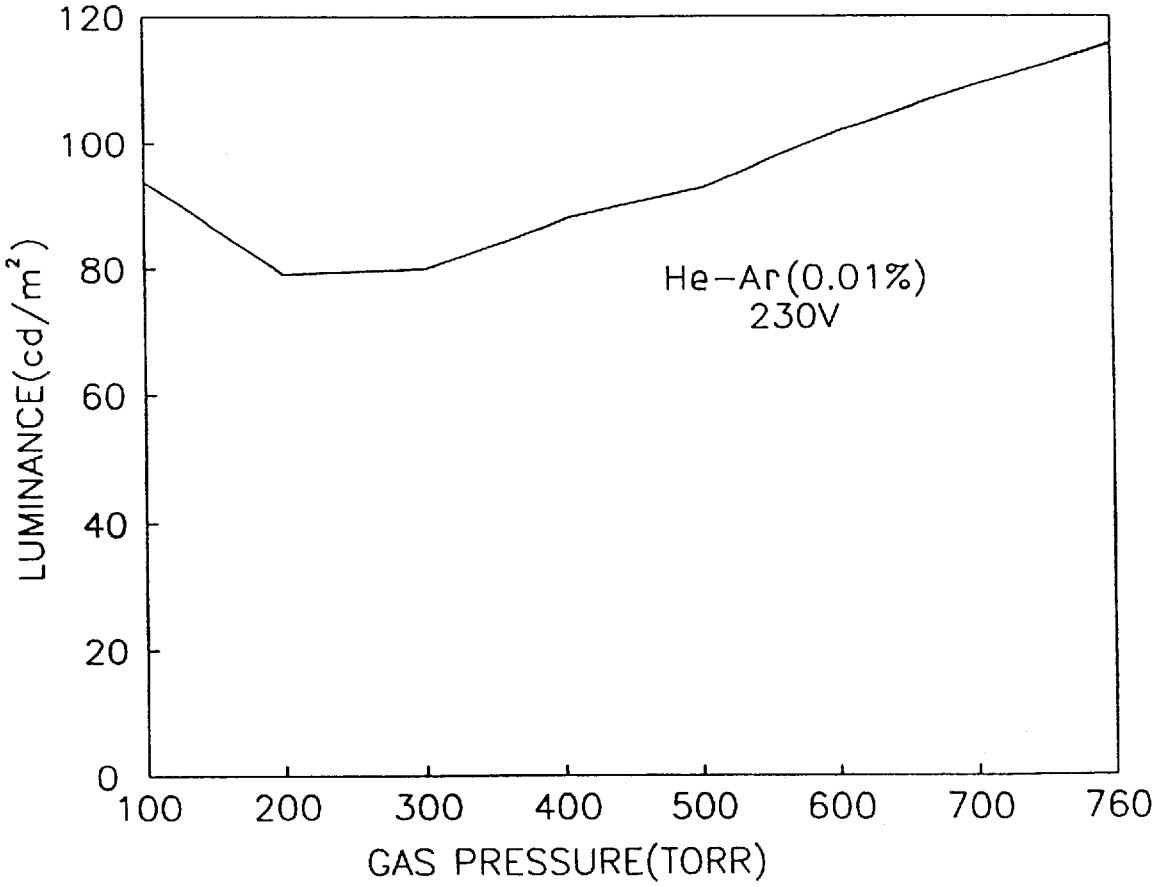
FIG. 6 is a graph illustrating the luminance variations corresponding to the pressure changes of a discharge display device employing a He—Ar (0.01 vol %) discharge gas according to the present invention.

FIG. 6 is a graph showing the results of another experiment showing luminance variations in accordance with the pressure variations of the He—Ar (0.01 vol %) discharge gas at a constant voltage. As seen in the shown results, luminance increases as pressure of the discharge gas increases, and it was found that gas discharge is stable even at pressure higher than 500 torr. However, when the pressure of the discharge gas is higher than 760 torr, the discharge panel may be deformed, and when the pressure of the discharge gas is lower than 100 torr, the efficiency of the emission of light is lowered, and the discharge start voltage becomes higher.

Figure 7:
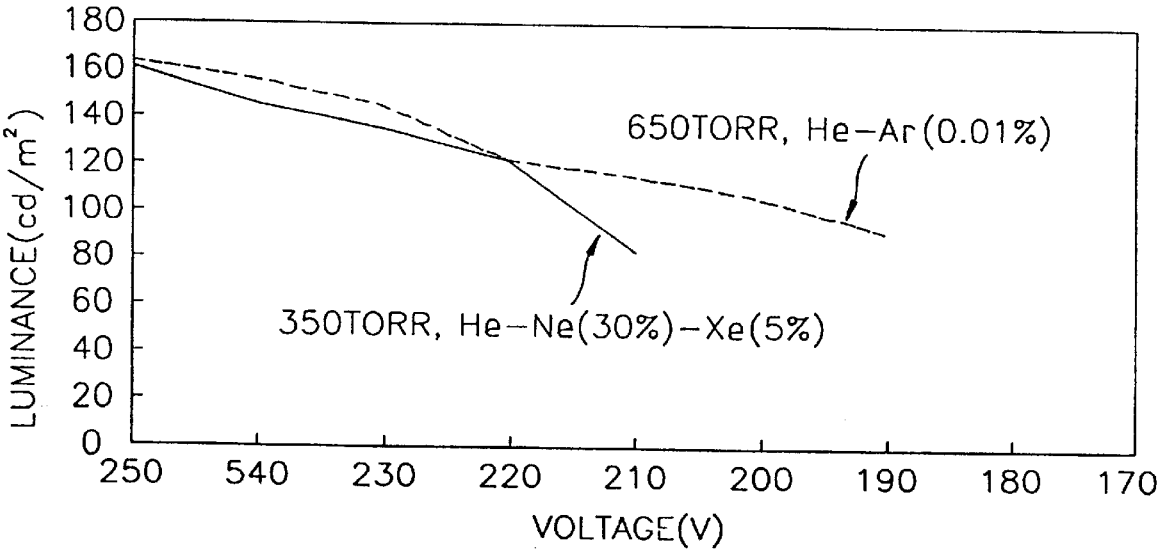
FIG. 7 is a graph illustrating the luminance variations corresponding to the respective voltage changes of a conventional discharge display device employing a He—Ne (30 vol %)-Xe (5 vol %) discharge gas of 350 torr and a display device employing a He—Ar (0.01 vol %) discharge gas of 650 torr according to the present invention.

FIG. 7 shows luminance variations measured according to voltages of the He—Ne (30 vol %)-Xe (5 vol %) discharge gas at 350 torr (shown in visible lines) and the He—Ar (0.01 vol %) discharge gas at 650 torr (shown in hidden lines). Among the experimental results, the luminance of the He—Ne (30 vol %)-Xe (5 vol %) discharge gas at 220 V was 122 cd/$m^2$, and the luminance of the He—Ar (0.01 vol %) discharge gas at 220 V was 123 cd/$m^2$. It was found that the luminance of the discharge gas decreases in proportion to the decrease of voltage. When a voltage is too low, discharge becomes unstable and partial emission appears. Such partial emission appears at voltages below 210 V in case of the He—Ne (30 vol %)-Xe (5 vol %) discharge gas, and at voltages below 190 V in case of the He—Ar (0.01 vol %) discharge gas.

As seen in FIG. 7, the luminance variations of the He—Ar (0.01 vol %) discharge gas according to the present invention are similar to those of the conventional He—Ne (30 vol %)-Xe (5 vol %) discharge gas.

Also, in an experimental example not shown, luminance variations of pure He, He—Ar, He—Ne—Ar, and He—Ne—Ar—Xe discharge gases were measured. In the experimental results, He—Ar (0.01 vol %) and He—Ar (0.005 vol %) exhibited the highest luminance, and He—Ne (30 vol %)-Xe (0.1 vol %), He—Ar (0.1 vol %), pure He, He—Ne (0.1 vol %)-Ar (0.1 vol %), He—Ne (0.1 vol %)-Ar (0.1 vol %)-Xe (0.1 vol %), He—Ne (0.5 vol %)-Ar (0.5 vol %), etc. exhibited gradually lower luminance in sequence.

Also, in the luminance characteristics according to the mixing ratios of mixture gases, it was found that the luminance of the He—Ar (0.5 vol %) discharge gas is similar to that of the He—Ne (0.1 vol %)-Ar (0.1 vol %)-Xe (0.1 vol %) discharge gas, and is no more than about half the luminance of the He—Ar (0.01 vol %) discharge gas.

On the other hand, the discharge voltages of He—Ne (0.1 vol %)-Ar (0.1 vol %), He—Ne (0.1 vol %)-Ar (0.1 vol %)-Xe (0.1 vol %) and He—Ar (0.1 vol %) were the lowest, and the discharge voltages of He—Ne (0.5 vol %)-Ar (0.5 vol %), He—Ar (0.01 vol %), He—Ar (0.005 vol %), pure He, and He—Ne (30 vol %)-Xe (5 vol %) were gradually higher in sequence. At this time, the difference in the discharge sustaining voltage between the lowest discharge voltage of He—Ne (0.1 vol %)-Ar (0.1 vol %) and the highest discharge voltage of He—Ne (30 vol %)-Xe (5 vol %) was about 50 V.

Though in the embodiment of the present invention, a surface discharge type plasma display device is employed, the present invention is not limited thereto, and therefore can be applied to various types of plasma display devices.

As described above, the He discharge display device according to the present invention emits little near infrared rays and therefore does not require a filter to shield the near infrared rays. Accordingly, there is no light loss on account of the filter and the production cost can be lowered since a filter for shielding the near infrared rays is not required.

What is claimed is:

1. A plasma display device including:

an upper substrate provided with address electrodes;

a dielectric material and a fluorescent material coated on the lower surface of the upper substrate;

a lower substrate provided with scan electrodes and common electrodes; and a discharge gas which is a mixture consisting of He, and the balance being about 0.01 vol % Ar, and hermetically sealed between the upper and lower substrates.

2. A plasma display device including:

an upper substrate provided with address electrodes;

a dielectric material and a fluorescent material coated on the lower surface of the upper substrate;

a lower substrate provided with scan electrodes and common electrodes; and a discharge gas which is a mixture consisting of He and the balance being about 0.005 vol % Ar, and hermetically sealed between the upper and lower substrates.

3. A plasma display device including:

an upper substrate provided with address electrodes;

a dielectric material and a fluorescent material coated on the lower surface of the upper substrate;

a lower substrate provided with scan electrodes and common electrodes; and a discharge gas which is a mixture consisting of He, about 0.1 vol % Ne, and about 0.1 vol % Ar, and hermetically sealed between the upper and lower substrates.

4. A plasma display device including:

an upper substrate provided with address electrodes;

a dielectric material and a fluorescent material coated on the lower surface of the upper substrate;

a lower substrate provided with scan electrodes and common electrodes; and a discharge gas which is a mixture consisting of He, the balance being about 0.05 vol % Ne, and about 0.05 vol % Ar, and hermetically sealed between the upper and lower substrates.

* * * * *